United States Patent [19]

Nicoll

[11] Patent Number: 4,503,122

[45] Date of Patent: Mar. 5, 1985

[54] HIGH-TEMPERATURE PROTECTION LAYER

[75] Inventor: Andrew R. Nicoll, Oftersheim, Fed. Rep. of Germany

[73] Assignee: BBC Aktiengesellschaft Brown, Boveri & Cie, Baden, Switzerland

[21] Appl. No.: 560,734

[22] Filed: Dec. 12, 1983

[30] Foreign Application Priority Data

Dec. 16, 1982 [DE] Fed. Rep. of Germany ..... 3246504

[51] Int. Cl.[3] ..... C23C 7/00

[52] U.S. Cl. ..... 428/678; 420/437; 428/633

[58] Field of Search ..... 428/678, 633; 420/437; 29/420.5

[56] References Cited

U.S. PATENT DOCUMENTS

| | | | |
|---|---|---|---|
| 4,095,003 | 6/1978 | Weatherly et al. | 428/633 |
| 4,110,893 | 9/1978 | Elam et al. | 29/420.5 |
| 4,321,310 | 3/1982 | Ulion et al. | 428/633 |
| 4,321,311 | 3/1982 | Strangman | 428/633 |

*Primary Examiner*—Veronica O'Keefe

*Attorney, Agent, or Firm*—Herbert L. Lerner; Laurence A. Greenberg

[57] ABSTRACT

High-temperature protection layer consisting of an alloy with a base of chromium, aluminum and cobalt, particularly for gas turbine parts of an austenitic material, characterized by the feature that at least silicon is admixed to the base material as an additive.

8 Claims, No Drawings

HIGH-TEMPERATURE PROTECTION LAYER

BACKGROUND OF THE INVENTION

1. Field of the Invention

The invention relates to a high-temperature protection layer of an alloy with a base of chromium, aluminum and cobalt adapted particularly for protecting parts of gas turbines subjected to high temperatures.

2. Description of the Prior Art

Such high-temperature protection layers find application in protecting the base material of parts or structural elements of heat-resistant steels and/or alloys which are used at temperatures above 600° C. These high-temperature protection layers are to retard the effect of high-temperature corrosion particularly of sulfur, oil ash, oxygen, earth alkalies and vanadium. The high-temperature protection layers are applied directly to the base material of the part. High-temperature protection layers are of particular importance in structural elements or parts of gas turbines. They are applied particularly to rotor and guide blades, as well as to segments of gas turbines subject to localized heat. In the manufacture of these parts, an austenitic material based on nickel, cobalt or iron is preferably used. In the manufacture of gas turbine parts, nickel super alloys particularly are used as the base material. The high-temperature protection layers to be applied consist preferably of chromium-containing alloys.

A high-temperature protection layer with a base material which contains cobalt, chromium and aluminum is known. This high-temerature layer is preferably applied to parts which are subjected to temperature effects substantially above 900° C. The structure of such a high-temperature protection layers has a matrix consisting of cobalt, chromium and aluminum, into which a cobalt-aluminum-containing phase is incorporated. This high-temperature protection layer has the property, under operating conditions in which the high-temperature protection layer is thermally stressed of forming a passive cover layer of aluminum oxide on its surface. If this high-temperature protection layer is subjected to the action of air and to a temperature of 950° for a time, corrosion occurs with the gradual removal of the passive cover layer. In the course of time upon the continuation of the high temperature-air conditions, the corrosion continues and also attacks the matrix. As a consequence, the cobalt-aluminum-containing phase which determines the mechanical strength of the high-temperature protection layer is removed in time, and the entire high-temperature protection layer destroyed.

SUMMARY OF THE INVENTION

An object of the invention is to provide a high-temperature protection layer with a base of cobalt, chromium and aluminum, which ensures particularly high mechanical strength as well as reliable adhesion to the base material to be protected, and on which a passive aluminum oxide cover layer can develop which is resistant to all corrosion.

With the foregoing and other objects in view, there is provided in accordance with the invention a high-temperature protection layer, adapted particularly for protecting gas turbine parts of an austenitic material subjected to a high temperature, of an alloy with a base material containing chromium, aluminum and cobalt, and at least silicon admixed to the base material as an additive to induce a resistant passive cover layer of aluminum oxide to develop on the alloy when subjected to a high temperature.

Other features which are considered as characteristic for the invention are set forth in the appended claims.

Although the invention is illustrated and described herein as embodied in high-temperature protection layer, it is nevertheless not intended to be limited to the details shown, since various modifications may be made therein without departing from the spirit of the invention and within the scope and range of equivalents of the claims. The invention, however, together with additional objects and advantages thereof will be best understood from the following description.

DETAILED DESCRIPTION OF THE INVENTION

The invention relates to a high-temperature protection layer of an alloy with a base of cobalt, chromium and aluminum. In order to give to the high-temperature protection layer improved mechanical strength as well as a more resistant passive aluminum oxide cover layer, at least one additive is admixed to the base material of the alloy. According to the invention, the additive consists of 1 to 2.5 by weight silicon. In addition, 0.7% by weight yttrium can be added to the alloy, by which the adhesion of the high-temperature protection layer to the base material is additionally increased.

The alloy according to the invention is in particular an oxide-precipitation-hardened alloy. A distinct improvement of the oxidation resistance of the high-temperature protection layer is achieved by the addition of an additive in the form of silicon. In addition, the high-temperature protection layer according to the invention exhibits a substantially better adhesion to the coated parts. This is achieved in particular by adding yttrium in an amount of 0.7% by weight to the base material of the alloy. An especially well formed and resistant passive aluminum oxide cover layer is obtained if silicon is added in an amount of 1 to 2.5% by weight. The above-mentioned weight data are relative to the total weight of the alloy. In tests, removal of the passive aluminum oxide cover layers at temperatures which are higher than 900° was not found. By virtue of the passive aluminum oxide cover layer in accordance with the invention, the high-temperature protection layer proper is protected against fast consumption and therefore contributes permanently (long, extended usage) to the protection of the part.

The base material of the high-temperature protection comprises 29% by weight chromium and 6% by weight aluminum, the remainder being cobalt. The quantities by weight given are relative to the total weight of the alloy. To this base material, 0.7% by weight yttrium as well as 1 to 2.5% by weight silicon based on the weight of the alloy are added in the alloy.

In investigations on the range of the matrix solubility it was determined that adding 1 to 2.5% by weight silicon to the alloy causes the precipitation of only one phase. Further precipitation could not be found by an addition of up to 2.5% by weight silicon to the alloy. For such investigations, the alloy is melted in a vacuum. Subsequently, the samples so obtained are heated alternatingly for one hour to 1000° C. in an oven and subsequently cooled down again to 100° C. within 30 minutes. An analysis of the samples shows a matrix composition of 31% by weight chromium, 2% by weight aluminum and 2.5% by weight silicon, the remainder being cobalt. The phase separated from the matrix has a composition consisting of 19% by weight chromium, 13.5% by weight aluminum and 2% by weight silicon, the remainder consisting of cobalt. The quantities by weight given are relative to the total weight of the matrix or the precipitated phase. In some samples, the precipitated phase also shows a silicon content which is between 0.5 and 2% by weight.

According to the invention, adding 2.25% by weight silicon to the alloy forms a particularly well adhering high-temperature protection layer, the passive aluminum oxide cover layer of which has the highest resistance to corrosion effects. According to the invention, the alloy is applied by means of plasma spraying by the low-pressure method, whereby an optimum bond between the part to be protected and the high-temperature protection layer is obtained.

The invention will be explained in greater detail with the aid of an embodiment example which describes the manufacture of a coated gas turbine part. The gas turbine part to be coated is made of an austenitic material, a nickel superalloy. Prior to the coating, the part is first chemically cleaned and then roughened by means of a sand blast. The part is coated in a vacuum by means of the plasma spraying method. The base material which forms the high-temperature protection layer, consists of a powder which contains 29% by weight chromium and 6% by weight aluminum, the rest being cobalt. According to the invention, 0.7% by weight yttrium and 1 to 2.5% by weight and preferably 2.25% by weight silicon are admixed to this base material. All weight data are relative to the total weight of the alloy. The alloy present in powder form has preferably a grain size of 45 um. The portions of the part which are not to be coated are covered. Sheet metal or graphite covers, for instance, can serve this purpose. Before the high-temperature protection layer is applied, the part is heated to about 800° C. by means of the plasma current. The alloy which forms the high-temperature protection layer is applied directly to the base material of the part. Argon and hydrogen are used as the plasma gas. The plasma current is 580 amps and the voltage applied is 80 volts. After the alloy is applied to the part, the latter is subjected to a heat treatment. The latter is conducted in a high-vacuum annealing furnace. In the latter, a pressure p is maintained which is less than $5\times10^{-3}$ Torr. After the vacuum is reached, the furnace is heated to a temperature of 1100° C. The above-mentioned temperature is maintained for about 1 hour with a tolerance of about ±4° C. Subsequently, the heating of the furnace is shut off. The coated, heat-treated part is allowed to cool down slowly in the furnace.

The foregoing is a description corresponding, in substance, to German application No. P 32 46 504.1, dated Dec. 16, 1982, international priority of which is being claimed for the instant application, and which is hereby made part of this application. Any material discrepancies between the foregoing specification and the specification of the aforementioned corresponding German application are to be resolved in favor of the latter.

I claim:

1. An article protected against corrosion at high-temperatures composed of a single applied high-temperature protection layer to a substrate, adapted particularly for protecting gas turbine parts of an austenitic material subjected to a high temperature, said single applied layer comprising: an oxide precipitation-hardened alloy with a base material consiting essentially of chromium, aluminum and cobalt, and at least silicon in an amount of 1 to 2.5% by weight relative to the total weight of the alloy added to the base material of the alloy as an additive prior to the application of the alloy to the substrate to induce a resistant passive cover layer of aluminum oxide to develop on the alloy when subjected to a high temperature, said applied alloy surface being without application of another layer of ceramic thereon.

2. An article protected against corrosion at high temperature composed of a single applied high-temperature protection layer to a substrate, adapted particularly for protecting gas turbine parts of an austenitic material subjected to a high temperature, said single applied layer comprising: an oxide precipitation-hardened alloy with a base material consisting essentially of 29% by weight chromium, 6% by weight aluminum, relative to the total weight of the alloy, and the remainder of the base material consisting of cobalt, and at least silicon in an amount of 1 to 2.5% by weight relative to the total weight of the alloy added to the base material of the alloy as an additive prior to application of the alloy to the substrate to induce a resistant passive cover layer of aluminum oxide to develop on the alloy when subjected to a high temperature, said applied alloy surface being without application of another layer of ceramic thereon.

3. High-temperature protection layer according to claim 1, wherein the silicon in an amount of 2.25% by weight relative to the total weight of the alloy is admixed to the base material of the alloy.

4. High-temperature protection layer according to claim 2, wherein the silicon in an amount of 2.25% by weight relative to the total weight of the alloy is admixed to the base material of the alloy.

5. High-temperature protection layer according to claim 1, wherein yttrium is admixed to the base material of the alloy as a further addition.

6. High-temperature protection layer according to claim 2, wherein yttrium is admixed to the base material of the alloy as a further addition.

7. High-temperature protection layer according to claim 5, wherein 0.5% by weight yttrium relative to the total weight of the alloy are admixed to the base material of the alloy.

8. High-temperature protection layer according to claim 6, wherein 0.5% by weight yttrium relative to the total weight of the alloy are admixed to the base material of the alloy.

* * * * *